US006594459B2

(12) United States Patent
Kamano et al.

(10) Patent No.: US 6,594,459 B2
(45) Date of Patent: Jul. 15, 2003

(54) IMAGE FORMING APPARATUS HAVING A PROCESS UNIT WHICH ENABLES A RECORDING SHEET JAMMED IN A CONVEYOR PATH TO BE EASILY REMOVED WITHOUT DAMAGE TO A PHOTOSENSITIVE DEVICE

(75) Inventors: Tadao Kamano, Shizuoka-ken (JP); Hiroyuki Hazu, Fujinomiya (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/981,250

(22) Filed: Oct. 16, 2001

(65) Prior Publication Data

US 2003/0072586 A1 Apr. 17, 2003

(51) Int. Cl.[7] ..... G03G 21/18
(52) U.S. Cl. ..... 399/113; 399/121; 399/124
(58) Field of Search ..... 399/113, 121, 399/124, 125, 111

(56) References Cited

U.S. PATENT DOCUMENTS 5,160,963 A * 11/1992 Haneda et al. ..... 399/113
5,371,575 A 12/1994 Sekino et al.

FOREIGN PATENT DOCUMENTS

| | | |
|---|---|---|
| JP | 63-135957 A | 6/1988 |
| JP | 5-35005 A | 2/1993 |
| JP | 5-45951 A | 2/1993 |

* cited by examiner

*Primary Examiner*—William J. Royer
(74) *Attorney, Agent, or Firm*—Frishauf, Holtz, Goodman & Chick, P.C.

(57) ABSTRACT

A process unit includes a unit body, a photosensitive device set in the unit body and designed to have a toner image formed thereon, a transfer unit body set in the unit and swingable between a first position in which the transfer unit body is located close to the photosensitive device to form a conveyor path for conveying a recording sheet between the transfer unit body and the photosensitive device, and a second position at a distance from the first position, and a transfer device set in the transfer unit body and capable of transferring the toner image formed on the photosensitive device to the recording sheet.

6 Claims, 5 Drawing Sheets

IMAGE FORMING APPARATUS HAVING A PROCESS UNIT WHICH ENABLES A RECORDING SHEET JAMMED IN A CONVEYOR PATH TO BE EASILY REMOVED WITHOUT DAMAGE TO A PHOTOSENSITIVE DEVICE

BACKGROUND OF THE INVENTION

The present invention relates to a process unit used in an image forming apparatus that adopts electrophotography and the image forming apparatus provided with the process unit.

An image forming apparatus that adopts electrophotography has a photosensitive device, charging device, exposing device, image developing device, transfer device, and fixing device set in its apparatus body, in order to record an image on a recording sheet. The charging device charges the photosensitive device, and the exposing device forms a latent image by exposing the photosensitive device. The image developing device develops the latent image on the photosensitive device and forms a toner image, the transfer device transfers the toner image on the photosensitive device to the recording sheet. The fixing device fixes the toner image on the recording sheet.

In the image forming apparatus, a process unit is constructed as combining a photosensitive device unit having a photosensitive device and a transfer unit having a charging device. More specifically, the process unit transfers a toner image on the photosensitive device to the recording sheet by means of the transfer device, while it transports a recording sheet along a conveyor path between the photosensitive device unit and a charging device unit.

There are some conventional image forming apparatuses, which detachably set a process unit that comprises a photosensitive device unit and a charging device unit as fixedly coupled to each other in the apparatus body. When a recording sheet has been stopped and jammed in a conveyor path of the process unit for any reason, in this arrangement, the recording sheet that jammed in the conveyor path is taken out by extracting the whole process unit from the apparatus body.

There are some other conventional image forming apparatuses which set the process unit that comprises a photosensitive device unit, that is fixed in the apparatus body, and a transfer unit as detachably coupled to each other in the apparatus body. When a recording sheet has been jammed in the conveyor path of the process unit, in this arrangement, the recording sheet, that jammed in the conveyor path, is taken out by detaching the transfer unit from the photosensitive device unit to uncover the conveyor path.

In the arrangement of the former process unit, however, it is very troublesome to take out the recording sheet because the operation of detaching the whole process unit from the apparatus body and the operation of re-attaching the whole process unit to the apparatus body are necessary to take out the recording sheet, that has jammed in the conveyor path, every time.

In the arrangement of the latter process unit, the photosensitive device of the photosensitive device unit is uncovered by detaching the transfer unit from the photosensitive device unit. Since the transfer unit is detached in order to take out the recording sheet jammed in the conveyor path, the photosensitive device may be damaged by touching a user's hand or the like.

BRIEF SUMMARY OF THE INVENTION

This invention provides a process unit, in which a recording sheet can be taken out by simple operation without damaging a photosensitive device in case the recording sheet is jammed in a conveyor path between a photosensitive device unit and a transfer unit, and an image forming apparatus provided with the process unit.

Thus, according to this invention, the jammed recording sheet can be taken out by swinging the transfer unit away from the photosensitive device unit to uncover the conveyor path.

This invention is a process unit comprising a photosensitive device unit and a transfer unit. The photosensitive device unit comprises a photosensitive device unit body, and a photosensitive device set in the photosensitive device unit body and designed to have toner image formed thereon. The transfer unit comprises a transfer unit body supported on the photosensitive device unit body and swingable between a first position in which the transfer unit body is located close to the photosensitive device to form a A conveyor path for conveying a recording sheet between the transfer unit body and the photosensitive device, and a second position at a distance from the first position, and a transfer device set in the transfer unit body and capable of transferring the toner image formed on the photosensitive device to the recording sheet.

This invention is an image forming apparatus comprising an apparatus body and a process unit housed in the apparatus body and comprising a photosensitive device unit and a transfer unit. The photosensitive device unit comprises a photosensitive device unit body and, a photosensitive device set in the photosensitive device unit body and designed to have a toner image formed thereon. The transfer unit comprises a transfer unit body supported on the photosensitive device unit body and swingable between a first position in which the transfer unit body is located close to the photosensitive device to form a conveyor path for conveying a recording sheet between the transfer unit body and the photosensitive device, and a second position at a distance from the first position, and a transfer device set in the transfer unit body and capable of transferring the toner image formed on the photosensitive device to the recording sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of this invention will be described with reference to the drawings.

Figure 1:
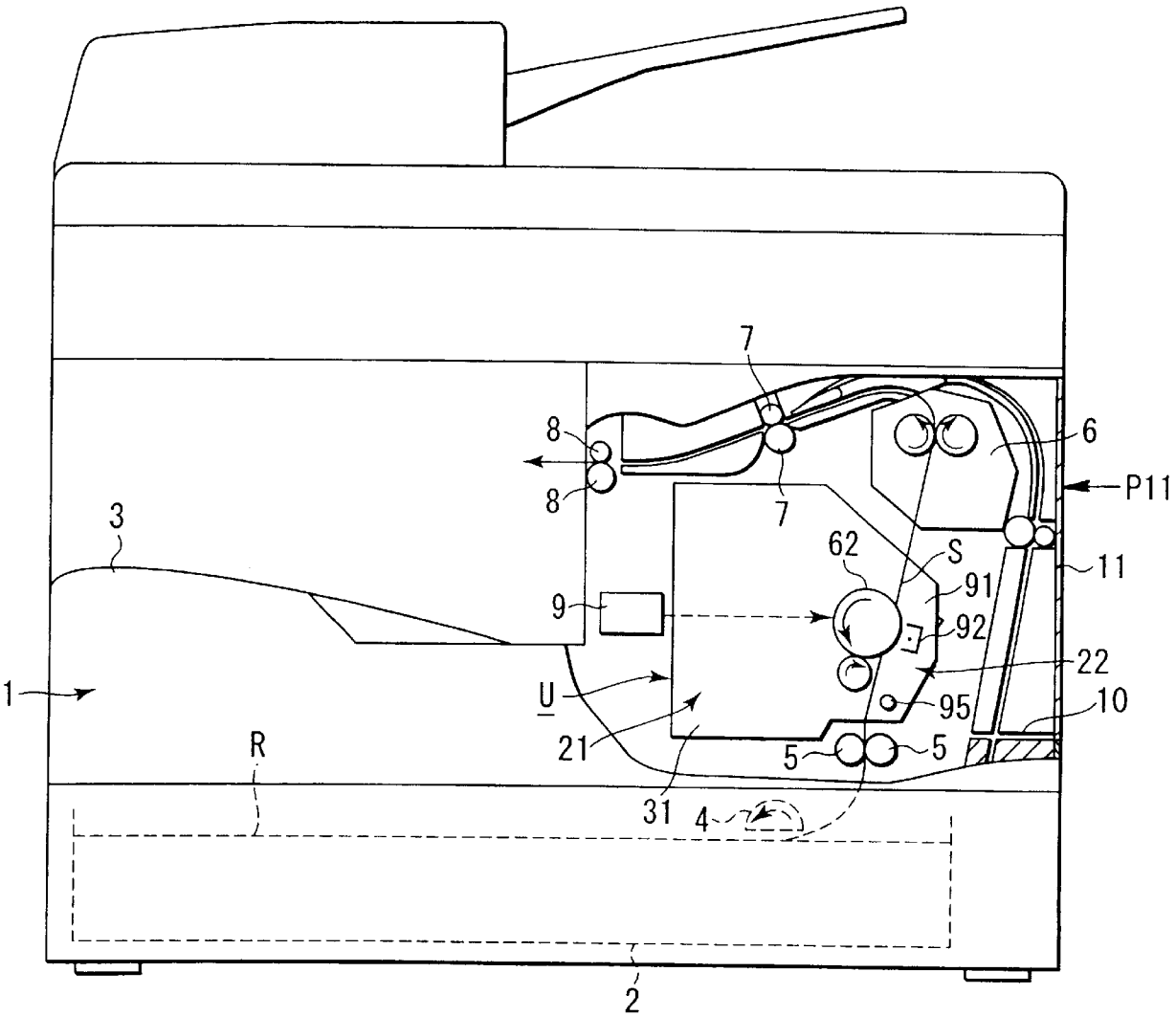
FIG. 1 is a cutaway front view showing a process unit portion in an image forming apparatus according to an embodiment of this invention.
Figure 2:
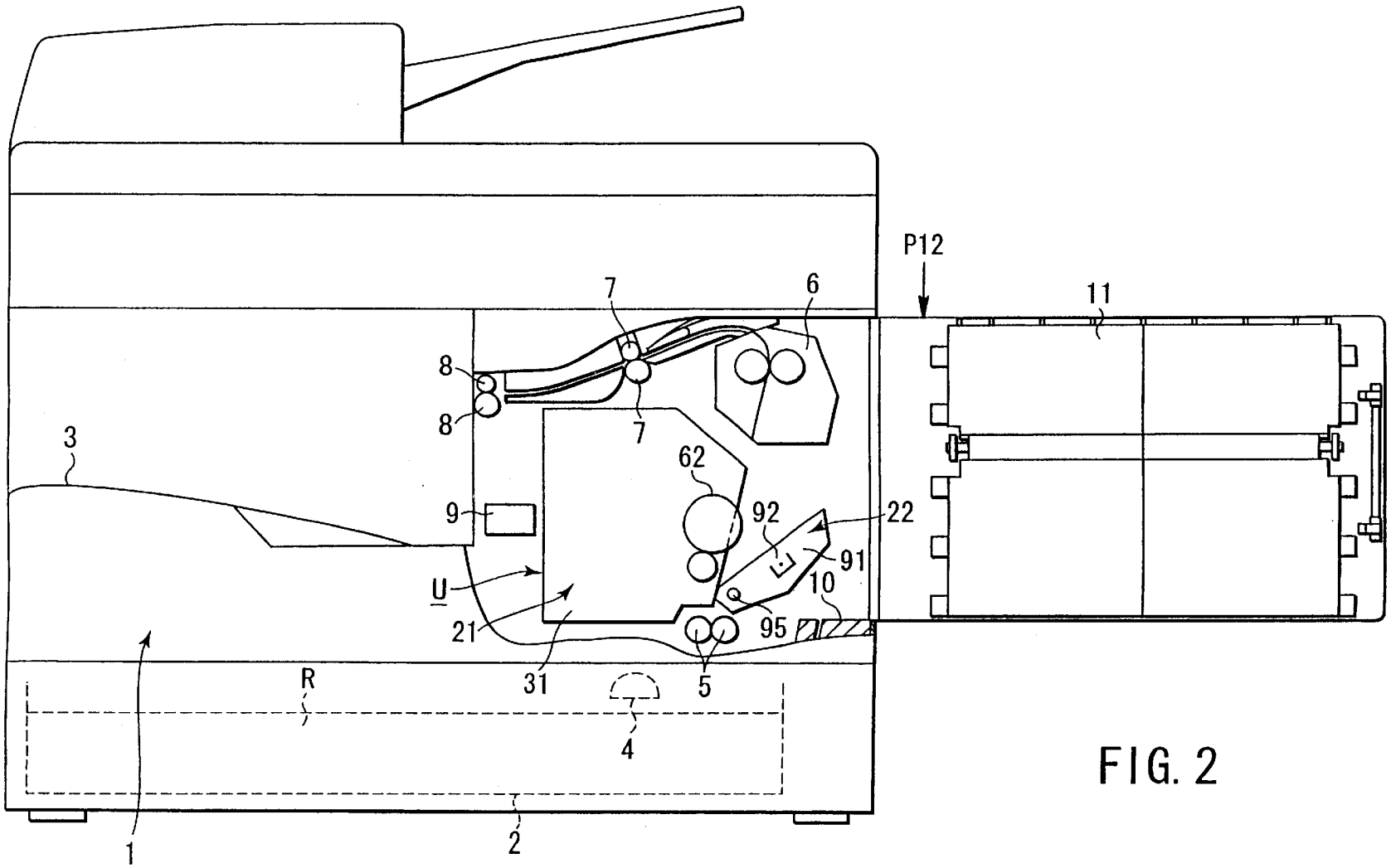
FIG. 2 is a cutaway front view showing the process unit portion in the image forming apparatus according to the same embodiment.
Figure 3:
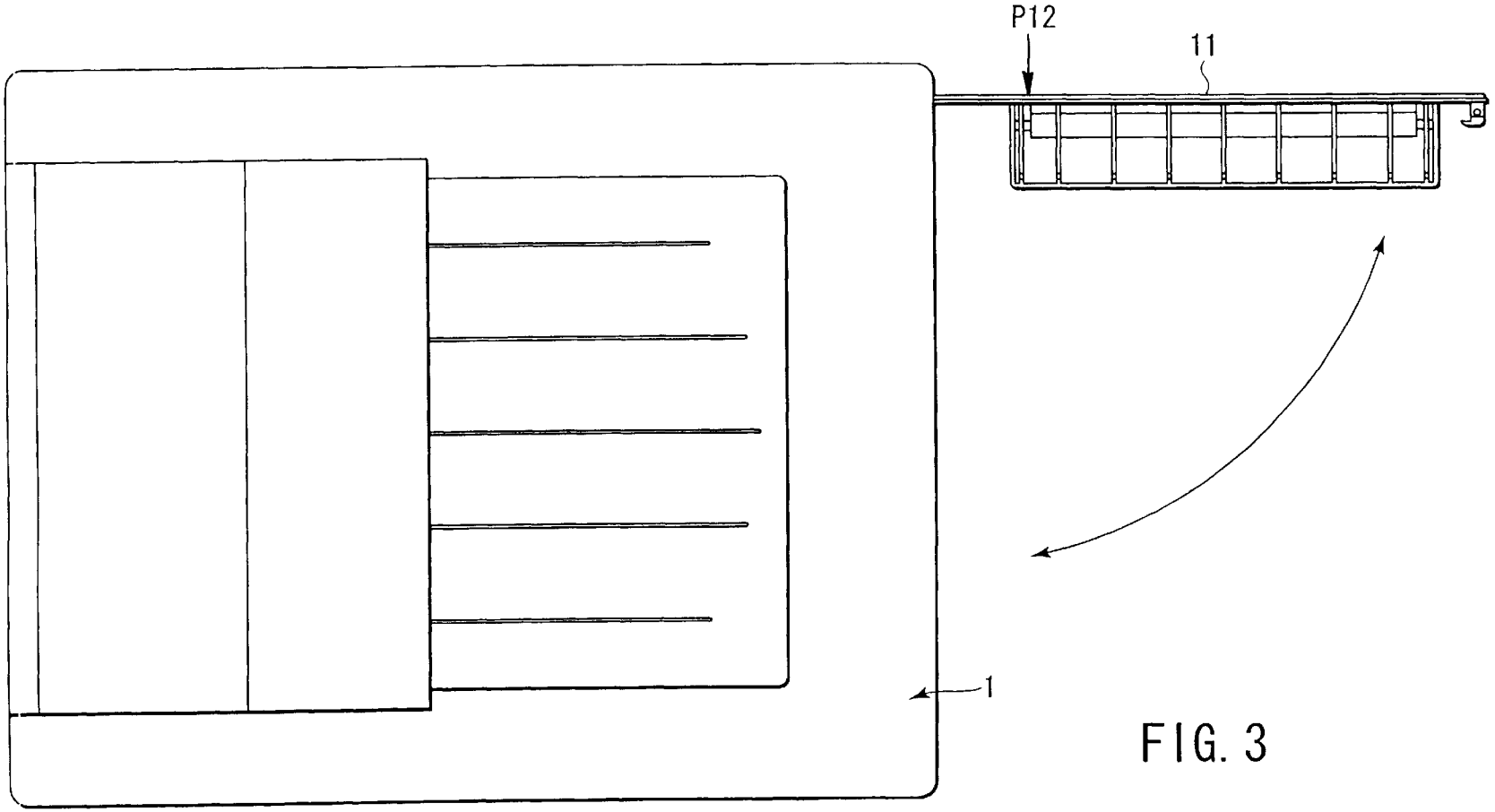
FIG. 3 is a plan view showing the image forming apparatus according to the same embodiment.

FIGS. 1 to 3 show an image forming apparatus. In an apparatus body 1, a process unit U is set in the middle portion and a paper cassette 2 is set in the lower portion. Recording sheets R are stored in layers in the paper cassette 2. A receiving tray 3 is set in the middle portion in the apparatus body 1. In the apparatus body 1, a paper-supply roller 4 and feed rollers 5 are located below the process unit U, and a fixing device 6, feed rollers 7, and exit rollers 8 are located above the process unit U. An exposing device 9 is set in the apparatus body 1.

The apparatus body 1 has an opening 10 in its vertical lateral part that faces the process unit U. The opening 10 has a size such that a user can insert his/her hand into the apparatus body 1 from outside the apparatus body 1. The apparatus body 1 is provided with a cover 11 on the aforesaid lateral part, and the cover 11 serves to cover and uncover the opening 10. More specifically, the cover 11 is supported on a vertical pivotal shaft (not shown) and can swing around the pivotal shaft between a closed position P11 shown in FIG. 1 in which it closes the opening 10 and an open position P12 shown in FIGS. 2 and 3 in which it opens the opening 10.

In this image forming apparatus, the paper-supply roller 4 rotates to feed the recording sheets R one after another from the paper cassette 2, and the feed rollers 5 rotate to transport the recording sheets R to the process unit U. The process unit U transfers a toner image to the recording sheets R, conveying the recording sheets R upward. The fixing device 6 fixes the transferred toner image on the recording sheets R, conveying the recording sheets R. The feed rollers 7 convey the recording sheets R by rotating, and the exit rollers 8 discharge the recording sheets R onto the receiving tray 3 by rotating.

The process unit U will now be described with reference to FIGS. 4 and 5.

Figure 4:
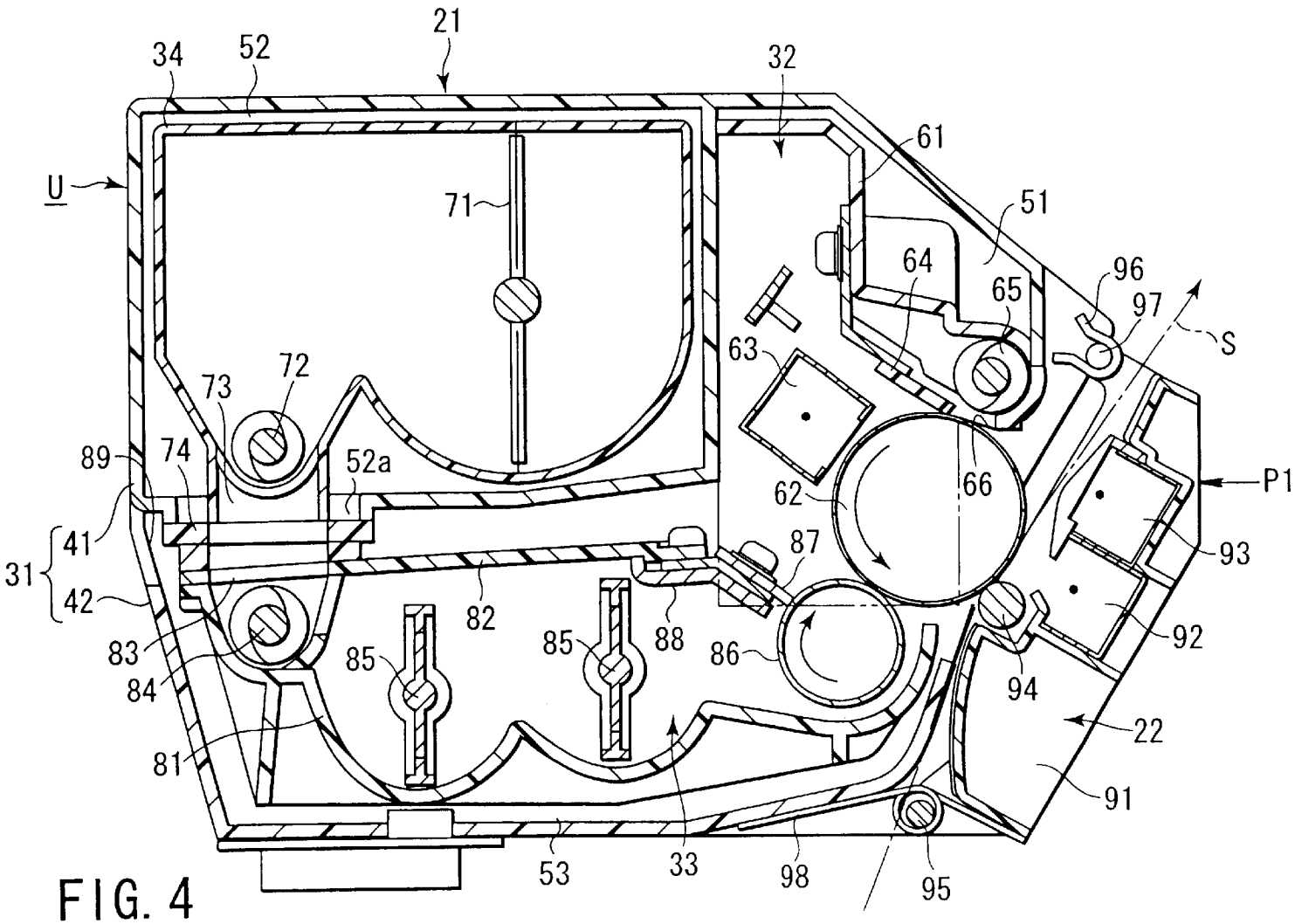
FIG. 4 is an enlarged sectional view showing a process unit according to the same embodiment.
Figure 5:
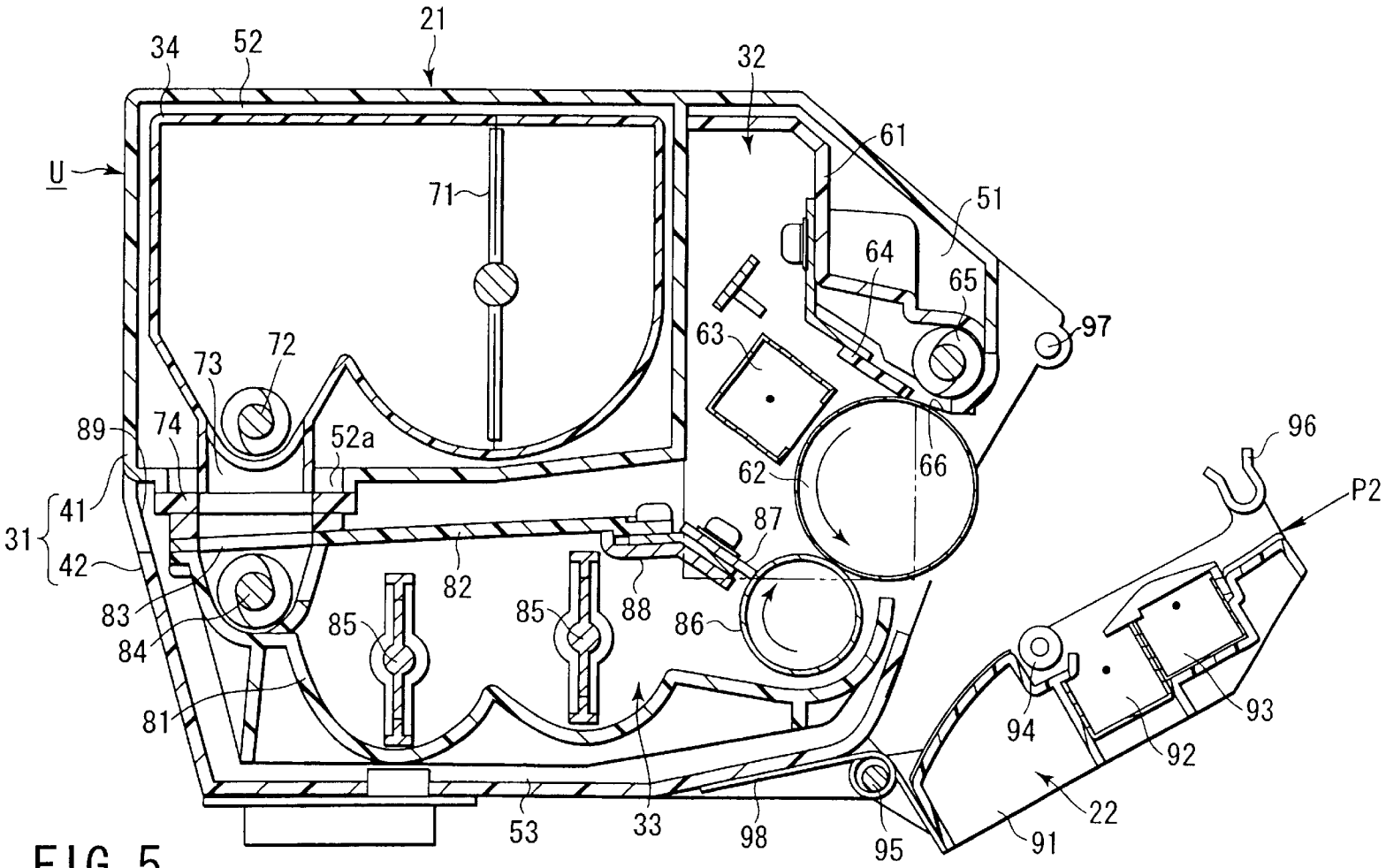
FIG. 5 is an enlarged sectional view showing the process unit according to the same embodiment.

FIGS. 4 and 5 are sectional views showing the process unit U. FIG. 4 shows a state in which a transfer unit 22 is closed, and FIG. 5 shows a state in which the transfer unit 22 is open. The process unit U comprises a photosensitive device unit 21 and a transfer unit 22.

The photosensitive device unit 21 includes a photosensitive device unit body 31, photosensitive device block 32, image developing device 33, and toner cartridge 34. The photosensitive device unit body 31 is formed as a housing that combines an upper housing 41 and a lower housing 42, and defines a space inside. The upper housing 41 is opened downward, and the lower housing 42 is opened upward. The upper housing 41 and the lower housing 42 are put together their respective open portions opposed to each other, and are removably coupled to each other by means of screws (not shown).

The upper housing 41 is formed in a manner such that a laterally elongate space 51 that can contain the photosensitive device block 32 and a laterally elongate chamber 52 that can contain the toner cartridge 34 are arranged extending parallel to each other. The photosensitive device block 32 includes a frame 61, photosensitive drum 62 as a photosensitive device, charging device 63, and cleaning blade 64. The frame 61 is laterally elongate. The photosensitive drum 62 is located in the frame 61 along in its lengthwise direction, and is rotatably supported on the frame 61.

A drive mechanism (not shown) is provided in the apparatus body 1 of the image forming apparatus, and the photosensitive drum 62 is rotated in the direction of the arrow by means of this drive mechanism.

The charging device 63 serves to charge the surface of the photosensitive drum 62 by means of a method that utilizes corona discharge, and has the same length with the photosensitive drum 62. The charging device 63 is attached to the frame 61, being located above the photosensitive drum 62 and disposed in parallel to the photosensitive drum 62.

The cleaning blade 64 serves to scrape off a toner that remains on the surface of the photosensitive drum 62 after the toner image on the surface of the photosensitive drum 62 is transferred to a recording sheet. The cleaning blade 64 is attached to the frame 61, as being located adjacent to the upstream side from the charging device 63 with respect to the rotating direction of the photosensitive drum 62.

A screw 65 carries out of the frame 61 the remaining toner that is scraped off from the photosensitive drum 62 by means of the cleaning blade 64 by rotating. The screw 65 is arranged side by side with the cleaning blade 64 in the frame 61. A sealing plate 66 serves to prevent the residual toner from leaking from the frame 61.

The photosensitive device block 32 is located in the space 51 of the upper housing 41, and the frame 61 is detachably attached to the upper housing 41 by means of screws (not shown).

The chamber 52 of the upper housing 41 is formed as a tube having a quadrangular cross section and opening at one end portion thereof. The toner cartridge 34, which is for storing the toner, has a toner outlet 73 formed in one end portion of its bottom. The toner cartridge 34 contains an agitator 71 for agitating the toner and a conveyor screw 72 for conveying the toner to the toner outlet 73. The toner cartridge 34 can be inserted into the chamber 52 through the opening of the chamber 52 and extracted out of the chamber 52 through the opening of the chamber 52. The bottom of the chamber 52 has a hole portion 52*a* that surrounds the toner outlet 73 of the toner cartridge 34.

The lower housing 42 has a space 53 inside, and the image developing device 33 is placed in the space 53. The image developing device 33 includes a toner casing 81 and a cover 82. The toner casing 81, which is for storing the toner, is opened top end. The cover 82, which covers a top opening of the toner casing 81, is detachably attached to the toner casing 81 by means of screws (not shown). The cover 82 is opened so that part of the open portion of the toner casing 81 is located under the photosensitive drum 62. The cover 82 has a toner inlet 83, and the toner inlet 83 is located under the toner outlet 73 of the toner cartridge 34.

A gasket 74 is attached to the upper surface portion of the cover 82, overlapping the toner inlet 83. The gasket 74 touches the toner outlet 73 of the toner cartridge 34 in an overlapping manner. The toner conveyed to the toner outlet 73 passes through the gasket 74 to the toner inlet 83, and is fed into the toner casing 81.

In the toner casing 81, a toner conveyor screw 84 is placed in a position under the toner inlet 83, and two agitators 85 and an image developing roller 86 are arranged in positions below the photosensitive drum 62. The toner conveyor screw 84, two agitators 85 and image developing roller 86 are arranged in parallel to the photosensitive drum 62, and are.rotatably set-.in the toner casing 81.

The toner conveyor screw 84, two agitators 85, and image developing roller 86 are individually rotated by means of a drive mechanism (not shown) that is provided in the apparatus body 1. The toner conveyor screw 84 conveys the toner that has come into the toner casing 81 to the central portion of the casing, and the agitators 85 send the toner to the image developing roller 86, agitating the toner. The image developing roller 86 is in contact with the photosensitive drum 62, being exposed through the opening portion of the toner casing 81 and locating under the photosensitive drum 62. The image developing roller 86 forms the toner image, by supplying the toner to the photosensitive drum 62 to develop a latent image on the photosensitive drum 62. A toner regulating member 87 is designed to touch the image developing roller 86, and a holder 88 is for attaching the toner regulating member 87 to the cover 82.

The image developing device 33 is inserted into the lower housing 42 through its open portion and attached to the lower housing 42.

A window 89 is formed at the connecting portion of the upper housing 41 and the lower housing 42. The window 89 is designed for making a beam of light pass through and shoot to the photosensitive drum 62 from the exposing device 9, passing through-it. A latent image is formed on the exposed photosensitive drum 62.

The transfer unit 22 will now be described. The transfer unit 22 is located outside the photosensitive device unit body 31, facing the photosensitive drum 62. The transfer unit 22 includes a transfer unit body 91, transfer device 92, corona discharging device 93, and guide roller 94. The transfer device 92, corona discharging device 93, and guide roller 94 are attached to the transfer unit body 91, and form a conveyor path S along with the photosensitive drum 62 for passing through the recording sheets R.

The transfer unit body 91 is attached to the lower housing 42 (photosensitive device unit body 31) by means of a pivotal shaft 95 at its lower end portion, and is provided to be able to swing around the pivotal shaft 95 in a direction such that it approaches or leaves (or covers or uncovers) the photosensitive device unit body 31 and the photosensitive drum 62. In other words, the transfer unit body 91 is swingable between a first position P1 shown in FIG. 4 in which it is located close to the photosensitive device unit body 31 and the photosensitive drum 62 and a second position P2 shown in FIG. 5 at a distance from the first position P1. The first position P1 is a position to form the conveyor path S in the vertical direction for conveying the recording sheet R between the transfer unit body 91 and the transfer device 92 on one side and the photosensitive device unit body 31 and the photosensitive drum 62 on the other side, standing upright the transfer unit body 91. The second position P2 is a position to open the conveyor path S by leaving the transfer unit body 91 and the transfer device 92 from the photosensitive device unit body 31 and the photosensitive drum 62. The second position P2 is a position that allows the user manually to take out the recording sheet R from the conveyor path S between the transfer unit body 91 and the transfer device 92 on one side and the photosensitive device unit body 31 and the photosensitive drum 62 on the other side when the recording sheet R has jammed and stopped to be conveyed in the conveyor path S.

The upper end portion of the transfer unit body 91 has a locking member 96, and the upper housing 41 has a pin 97 that can be joined to the locking member 96. When the transfer unit body 91 is in its first position P1, the locking member 96 keeps the transfer unit body 91 in the closed condition, being joined detachably to the pin 97. A torsion coil spring 98 is supported on the pivotal shaft 95, and urges the transfer unit body 91 to approach the photosensitive device unit body 31.

The transfer device 92 is located facing the photosensitive drum 62, and serves to transfer the toner image on the photosensitive drum 62 to each of the recording sheets R. The transfer device 92, which is a corona-discharge type, makes transfer of the image, applying electric charge to the recording sheet and bringing it into contact with the photosensitive drum 62. The corona discharging device 93 is for stripping off the recording sheet R in contact with the photosensitive drum 62, applying electric charge to the recording sheet R by utilizing the corona discharge, and is located on the downstream side from the transfer device 92 with respect to the direction of conveying of the recording sheet R. The guide roller 94 is for guiding the recording sheet R to the transfer device 92, and is located on the upstream side from the transfer device 92 with respect to the direction of conveying of the recording sheet R.

The process unit U constructed in this manner is set in a position opposite to the opening 10 in the apparatus body 1. The process unit U is arranged in a direction making the transfer unit 22 face the opening 10 of the apparatus body 1. The transfer unit 22 of the process unit U is located in a position near the opening 10 of the apparatus body 1, and the user can touch it with their hand through the opening 10.

Normally, when image forming is performed, the transfer unit body 91 of the transfer unit 22 is located in the first position P1 as shown in FIGS. 1 and 4, and is held in the first position P1 by joining the locking member 96 and the pin 97 to each other. The transfer unit body 91 forms the conveyor path S in the vertical direction along which the recording sheet R is conveyed between itself and the photosensitive device unit body 31 and the photosensitive drum 62, by standing up. The recording sheet R is conveyed from under of the process unit U, moves along the conveyor path S, and is conveyed to the position over the process unit U. While the recording sheet R is conveyed along the conveyor path S, the toner image on the photosensitive drum 62 is transferred to the recording sheet R by means of the transfer device 92. The cover 11 of the apparatus body 1 is in its closed position P11, and closes the opening 10.

When a recording sheet R has jammed and stopped conveying in the conveyor path S of the process unit U, the recording sheet R is taken out from the conveyor path S of the process unit U. The cover 11 of the apparatus body 1 uncovers the opening 10, swinging from the closed position P11 to the open position P12, as shown in FIGS. 2 and 3. The user inserts his/her hand into the apparatus body 1 from outside of the apparatus body 1 through the opening 10, and manipulates the transfer unit 22 of the process unit U. The joining of the locking member 96 and the pin 97 are disengaged. The conveyor path S is opened, by swinging the transfer unit body 91 from the first position P1 to the second position P2 for leaving from the photosensitive device unit body 31 and the photosensitive drum 62. The recording sheet R is taken out from the conveyor path S between the transfer unit body 91 and the photosensitive device unit body 31 as well as photosensitive drum 62.

The operation for taking out the recording sheet R jammed in the process unit U in this manner, can be carried out by simple manipulation such that the transfer unit 22 is swung to disengage the joining with the photosensitive device unit 21 without ejecting the whole process unit U from the apparatus body 1. Further, a structure for combining the photosensitive device unit 21 and the transfer unit 22 is simple. The transfer unit 22 can cover and uncover the photosensitive device unit 21 without being detached from the photosensitive device unit 21. Thus, when the recording sheet R is taken out from the process unit U, the photosensitive drum 62 is not damaged, because the user's hand seldom touches the photosensitive drum 62 and the transfer unit 22 serves to block the photosensitive drum 62 from the outside. Since the transfer unit 22 is swingable attached to the photosensitive device unit 21, it is easy to maintain the positional accuracy of the photosensitive drum 62 and the transfer device 92. Since the transfer device 92 of the transfer unit 22 is a corona-discharge type, it is easy to adjust the position relative to the photosensitive drum 62 by attaching a swingable transfer unit 22.

Additional advantages and modifications will readily.occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A process unit comprising a photosensitive device unit and a transfer unit, wherein:

said photosensitive device unit comprises a photosensitive device unit body, and a photosensitive device set in the photosensitive device unit body to carry a toner image thereon, an image developing device to form the toner image on the photosensitive device, and a toner cartridge for storing toner and applying the toner to the image developing device, and said transfer unit comprises a transfer unit body supported on said photosensitive device unit body and swingable between a first position in which the transfer unit body is located close to said photosensitive device to form a conveyor path for conveying a recording sheet between the transfer unit body and said photosensitive device, and a second position at a distance from the first position, and a transfer device set in the transfer unit body and capable of transferring the toner image formed on said photosensitive device to said recording sheet.

2. A process unit according to claim 1, wherein said transfer device uses corona discharge.

3. A process unit according to claim 1, wherein said transfer unit body is swingably supported on said photosensitive device unit body at a lower end portion.

4. A process unit according to claim 1, wherein said photosensitive device unit body comprises a charging device which charges said photosensitive device and an image developing device which forms the toner image on said photosensitive device.

5. An image forming apparatus comprising:

an apparatus body; and a process unit housed in the apparatus body and comprising a photosensitive device unit and a transfer unit, wherein:

said photosensitive device unit comprises a photosensitive device unit body, and a photosensitive device set in the photosensitive device unit body to carry a toner image thereon, an image developing device to form the toner image on the photosensitive device, and a toner cartridge for storing toner and applying the toner to the image developing device, and said transfer unit comprises a transfer unit body supported on said photosensitive device unit body and swingable between a first position in which the transfer unit body is located close to said photosensitive device to form a conveyor path for conveying a recording sheet between the transfer unit body and said photosensitive device, and a second position at a distance from the first position, and a transfer device set in the transfer unit body and capable of transferring the toner image formed on said photosensitive device to said recording sheet.

6. An image forming apparatus according to claim 5, wherein said apparatus body comprises an opening facing the transfer unit body of said process unit, and a cover capable of covering and uncovering the opening.

* * * * *